US010525296B2

(12) United States Patent
Kjellman

(10) Patent No.: US 10,525,296 B2
(45) Date of Patent: Jan. 7, 2020

(54) EXTERNALLY MOUNTED DEVICE FOR THE SUPERVISION OF A FIRE SUPPRESSION SYSTEM

(71) Applicant: UTC Fire & Security Corporation, Farmington, CT (US)

(72) Inventor: Thomas Kjellman, Ashland, MA (US)

(73) Assignee: UTC Fire & Security Corporation, Farmington, CT (US)

( * ) Notice: Subject to any disclaimer, the term of this patent is extended or adjusted under 35 U.S.C. 154(b) by 77 days.

(21) Appl. No.: 15/579,031

(22) PCT Filed: May 25, 2016

(86) PCT No.: PCT/US2016/034022
§ 371 (c)(1),
(2) Date: Dec. 1, 2017

(87) PCT Pub. No.: WO2016/196104
PCT Pub. Date: Dec. 8, 2016

(65) Prior Publication Data

US 2018/0161610 A1 Jun. 14, 2018

Related U.S. Application Data

(60) Provisional application No. 62/170,741, filed on Jun. 4, 2015.

(51) Int. Cl.
*A62C 37/50* (2006.01)
*A62C 35/02* (2006.01)

(52) U.S. Cl.
CPC ..... *A62C 37/50* (2013.01); *A62C 35/02* (2013.01); *A62C 35/023* (2013.01)

(58) Field of Classification Search
CPC ..... A62C 35/02; A62C 35/023; A62C 37/50
See application file for complete search history.

(56) References Cited

U.S. PATENT DOCUMENTS 5,031,660 A 7/1991 Magee
6,037,867 A 3/2000 Joseph et al.
(Continued)

FOREIGN PATENT DOCUMENTS

EP 0717648 A1 6/1996

OTHER PUBLICATIONS

Extended European Search Report dated Feb. 6, 2019, issued during the prosecution of European Patent Application No. EP 18199306.4 (7 pages).

(Continued)

*Primary Examiner* — Ryan A Reis
(74) *Attorney, Agent, or Firm* — Locke Lord LLP; Scott D. Wofsy; Joshua L. Jones

(57) ABSTRACT

A supervised fire suppression system (10) is disclosed that includes a valve assembly for controlling the release of a fire extinguishing agent from a container (17), an actuator (25) operatively associated with the valve assembly for actuating the valve assembly in the event of a fire, wherein the actuator may be removed from the system for periodic inspection and/or maintenance, and an externally mounted supervisory switching device (16, 30) configured to interact with the actuator to provide an indication relating to removal or disengagement of the actuator from the system for periodic inspection and/or maintenance.

6 Claims, 5 Drawing Sheets

(56) References Cited

U.S. PATENT DOCUMENTS

| | | | | |
|---|---|---|---|---|
| 7,889,091 | B2 * | 2/2011 | Goon | A62C 37/50<br>340/644 |
| 2007/0247265 | A1 * | 10/2007 | Medrano | A62C 37/00<br>335/282 |
| 2013/0126328 | A1 * | 5/2013 | Mainland | H01H 35/26<br>200/81 R |
| 2013/0240222 | A1 | 9/2013 | Krueger | |
| 2018/0133529 | A1 * | 5/2018 | Kjellman | A62C 35/02 |

OTHER PUBLICATIONS

Written Opinion of the International Searching Authority dated Jul. 29, 2016, issued with the PCT International Search Report dated Jul. 29, 2016, during the prosecution of PCT International Patent Application No. PCT/US2016/034022 (6 pages).

International Search Report issued in PCT/US2016/034022, dated Jul. 29, 2016.

* cited by examiner

EXTERNALLY MOUNTED DEVICE FOR THE SUPERVISION OF A FIRE SUPPRESSION SYSTEM

CROSS REFERENCE TO RELATED APPLICATIONS

This application is a 35 U.S.C. § 371 National Phase Application of International PCT Patent Application No. PCT/US2016/034022, filed on May. 25, 2016, which claims the benefit of the U.S. Provisional Application Ser. No. 62/170,741, filed Jun. 4, 2015, and entitled EXTERNALLY MOUNTED DEVICE FOR THE SUPERVISION OF A FIRE SUPPRESSION SYSTEM. The entire contents of these applications are incorporated herein by reference in their entirety.

BACKGROUND OF THE INVENTION

1. Field of the Invention

The subject invention is directed to supervised fire suppression systems, and more particularly, to externally mounted switching devices for detecting the removal of an actuator intended to activate a discharge valve on a storage container holding pressurized fire suppressant, so as to ensure that the actuator is replaced after it has been inspected.

2. Description of Related Art

Fire safety systems installed in buildings typically include at least one electrical panel that is the controlling component of the fire safety system. The control panel is a hub of the safety system. It monitors inputs and system integrity, controls outputs and relays information. The control panel receives information from environmental sensors that detect environmental changes associated with fire, monitors their operational integrity and provides for automatic control of equipment, which may include release of fire suppressant, transmission of information necessary to provide notification to fire fighters, and control of a variety of building functions to prepare the facility for fire based on a predetermined sequence of events.

A typical unit in the system is a storage container which contains a firefighting agent under pressure. The storage container is usually a cylinder and often includes a valve connected to a control head that is connected pneumatically or electrically to the control panel. The control panel can send a signal to the control head to activate a release mechanism, such as a solenoid actuator, opening the valve and releasing the firefighting agent from the container. The agent then passes through an outlet port in the valve to a piping network that distributes the firefighting agent to a series of interconnected nozzles placed throughout an installation, for example, in a building, where the agent is then discharged. The control panel can be programmed to automatically send a signal to the control head to open the valve to release the agent when a detector detects a fire. In certain instances, the valve can also be activated manually.

Specific monitoring and checks of the control heads and the fire safety system in general are required by National Fire Protection Association (NFPA) standards and codes. This is typically done through physical inspection by trained personnel at the container. It involves manually disconnecting the control head from the valve to physically inspect it at specific intervals, for example, every six months, then reconnecting the control head to the valve. Additionally, agent storage containers must be physically inspected to monitor levels of agent, pressure, temperature and other conditions. In addition, cleaning of the fire safety systems requires manually disconnecting the control head from the valve, which requires that the control head and valve then be manually reconnected.

SUMMARY OF THE INVENTION

The subject invention is directed to a new and useful fire suppression system that includes a container for storing a pressurized fire extinguishing agent, a valve assembly operatively associated with the container for controlling the release of the fire extinguishing agent from the container, an actuator operatively associated with the valve assembly for actuating the valve assembly in the event of a fire, wherein the actuator may be readily removed from the fire suppression system for inspection and/or maintenance, and an external switching device configured to interact with the actuator to provide an indication relating to removal of the actuator from the system. Preferably, the external switching device communicates with a control panel that is located remote from the actuator, where an indication or alarm relating to removal of the actuator is provided.

In one embodiment of the subject invention, the actuator is a solenoid valve disposed within a control head, and the control head is detachably connected to a discharge valve assembly. In this case, the external supervisory switching device is mounted between the control head and the discharge valve assembly. It includes a housing containing a pivoting trigger and a micro switch in spring biased contact with the trigger. The trigger is adapted and configured to physically interact with a swivel nut that detachably connects the control head to the discharge valve assembly.

More particularly, the pivoting trigger is adapted and configured to move between a first position in contact with the swivel nut corresponding to the control head being connected to the discharge valve assembly so that the micro switch is in a first state, and a second position out of contact with the swivel nut corresponding to the control head being removed from the discharge valve assembly so that the micro switch is in a second state to provide an indication that the actuator has been removed from the system for maintenance and/or inspection.

In another embodiment of the subject invention, the actuator is a solenoid valve detachably mounted to a pneumatic actuator, and the pneumatic actuator is mounted to a ball valve assembly by way of a mounting bracket. In this case, the external supervisory switching device is mounted on a supervision bracket that is removably connected to a housing of the solenoid valve. Removal of the supervision bracket is required to gain access to the solenoid valve for maintenance and/or inspection.

It is envisioned that the external switching device can include a micro switch operated by physical contact with the housing of the solenoid valve, or the external switching device can include a proximity switch operated by physical proximity to a magnetic target located on the housing of the solenoid valve.

The subject invention is also directed to a fire suppression system that includes a discharge valve for controlling the release of a fire extinguishing agent from a container, a control head housing an electronic actuator that is operatively associated with the discharge valve for actuating the discharge valve in the event of a fire, wherein the control head may be removed from the discharge valve to facilitate maintenance and/or inspection of the electronic actuator housed within the control head, and an external supervisory switching device supported on the discharge valve and configured to interact with the control head to provide an indication that the control head has been removed from the discharge valve.

The external switching device communicates with a control panel located remote from the control head where an indication relating to removal of the control head from the discharge valve is provided. The electronic actuator is a solenoid valve housed within the control head, and the control head is detachably connected to the discharge valve by a swivel nut operatively secured to the control head. The external switching device includes a housing containing a pivoting trigger and a micro switch in spring biased contact with the trigger. The trigger is adapted and configured to physically interact with the swivel nut secured to the control head.

More particularly, the pivoting trigger is adapted and configured to move between a first position in contact with the swivel nut corresponding to the control head being connected to the discharge valve so that the micro switch is in a first state and a second position out of contact with the swivel nut corresponding to the control head being removed from the discharge valve so that the micro switch is in a second state to provide an indication that the control head has been removed from the discharge valve.

The subject invention is further directed to a fire suppression system that includes a ball valve for controlling the release of a fire extinguishing agent from a storage container, a pneumatic actuator operatively associated with the ball valve for actuating the ball valve in the event of a fire, wherein the pneumatic actuator includes a solenoid valve that may be removed from the system for maintenance and/or inspection, and an external supervisory switching device configured to interact with the pneumatic actuator to provide an indication relating to removal of the solenoid valve from the pneumatic actuator.

The external switching device communicates with a control panel located remote from the pneumatic actuator where an indication relating to removal of the solenoid valve from the pneumatic actuator is provided. The external switching device is mounted on a supervision bracket that is removably connected to a housing of the solenoid valve, by threaded fasteners. Removal of the supervisory bracket is required to gain access to the solenoid valve for scheduled maintenance. The external switching device includes either a micro switch operated by physical contact with the housing of the solenoid valve, or a proximity switch operated by physical proximity to a magnetic target located on the housing of the solenoid valve.

These and other features of the subject invention and the manner in which it is made and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the supervised fire suppression system of the subject invention without undue experimentation, preferred embodiments thereof will be described in detail herein below with reference to certain figures, wherein.

DETAILED DESCRIPTION OF PREFERRED EMBODIMENTS

Figure 1:
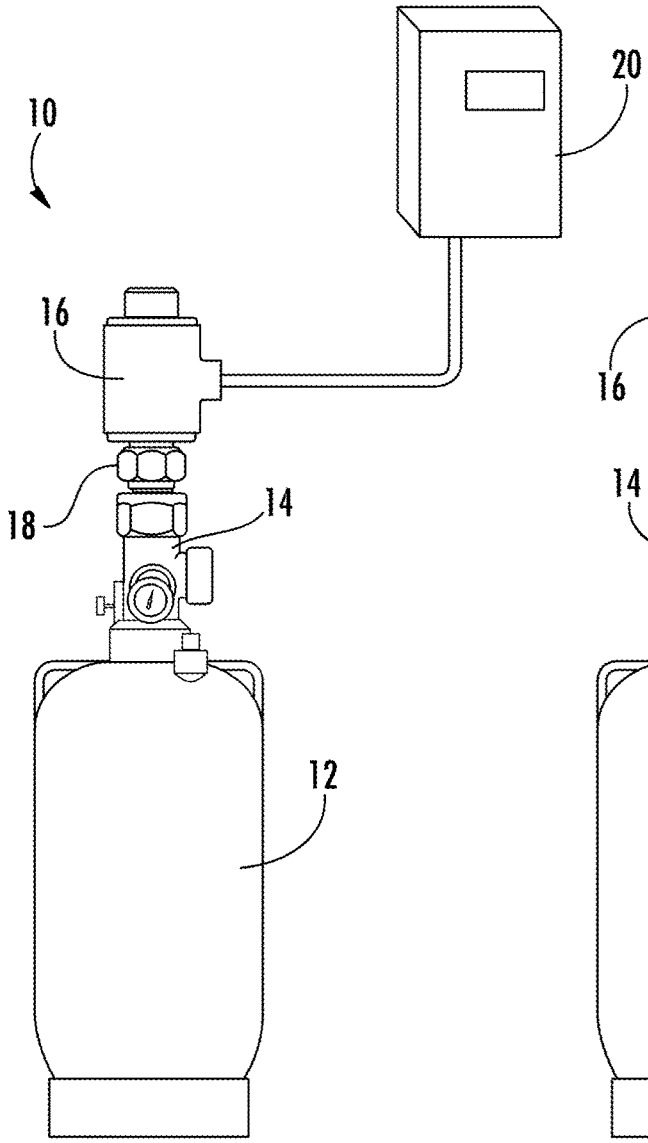
FIG. 1 is a schematic illustration of a supervised fire suppression system constructed in accordance with a preferred embodiment of the subject invention, wherein the control head housing the actuator is attached to the discharge valve on the storage container which holds a pressurized fire extinguishing agent.

Referring now to the drawings, wherein like reference numerals identify similar structural features or aspects of the subject invention, there is illustrated in FIG. 1 a fire suppression system constructed in accordance with an embodiment of the subject invention and designated generally by reference numeral 10.

The fire suppression system 10 of the subject invention includes a container or cylinder 12 for storing a pressurized fire extinguishing agent. A discharge valve assembly 14 is operatively associated with the container 12 for controlling the release of the fire extinguishing agent therefrom. An electronic control head 16 is installed onto the valve assembly 14 by way of a threaded swivel nut 18. The control head 16 houses an electronic solenoid valve (not shown) for actuating the valve assembly 14 in the event of a fire.

Figure 2:
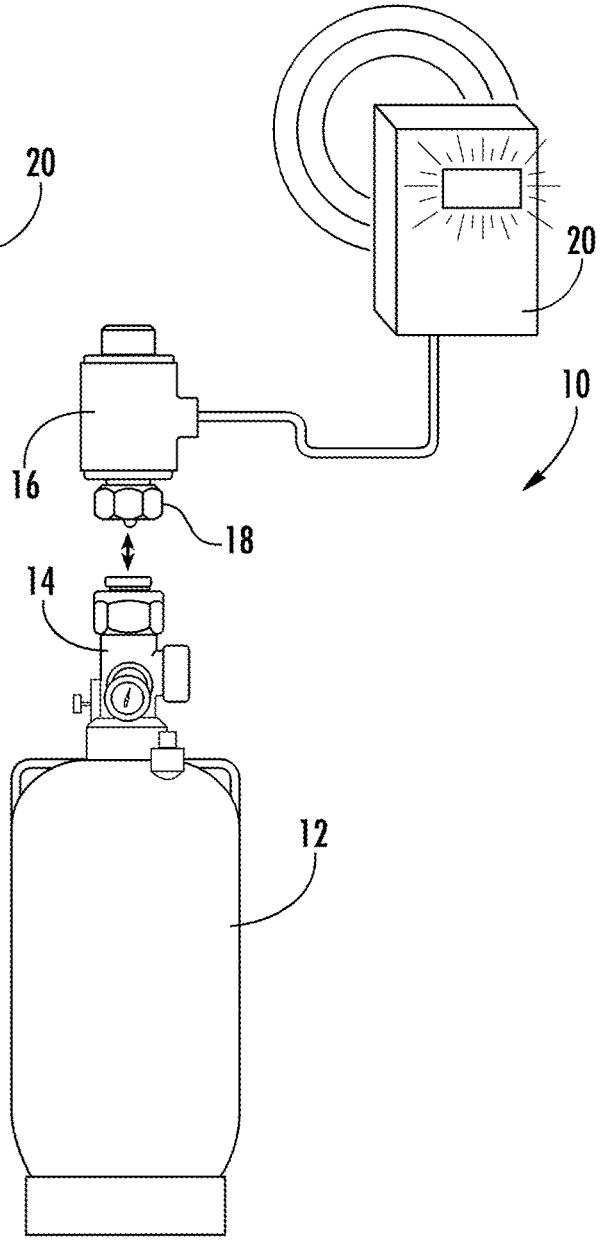
FIG. 2 is a schematic illustration of the supervised fire suppression system shown in FIG. 1, wherein the control head housing the actuator has been removed from the discharge valve on the storage container, as indicated by an audible and visual signal provided at the control panel.

The control head 16 is adapted and configured to be readily removed from the valve assembly 14 by way of the swivel nut 18 to facilitate scheduled maintenance checks and monitoring of the solenoid valve housed therein, as shown for example in FIG. 2. Periodic inspection of the control head and the fire safety system in general are required by National Fire Protection Association (NFPA) standards and codes.

In one aspect of the subject invention, the control head 16 communicates with a control panel 20 that is located remote from the control head 16, where an indication relating to system impairment, and more particularly, to the removal of the control head 16 is provided. The communication link is typically a wired connection as illustrated in FIGS. 1 and 2, but it is envisioned that the control head 16 could be wirelessly linked to the control panel 20.

Upon removal or disengagement of the control head 16 from the valve assembly 14 for inspection and/or maintenance, the indication provided at the control panel 20 can be an audible and/or a visual alarm. When the actuator 16 is connected to or otherwise properly installed on the valve assembly 14 after it has been inspected, the control panel 20 can provide a signal indicating that the fire suppression system 10 is ready.

Figure 3:
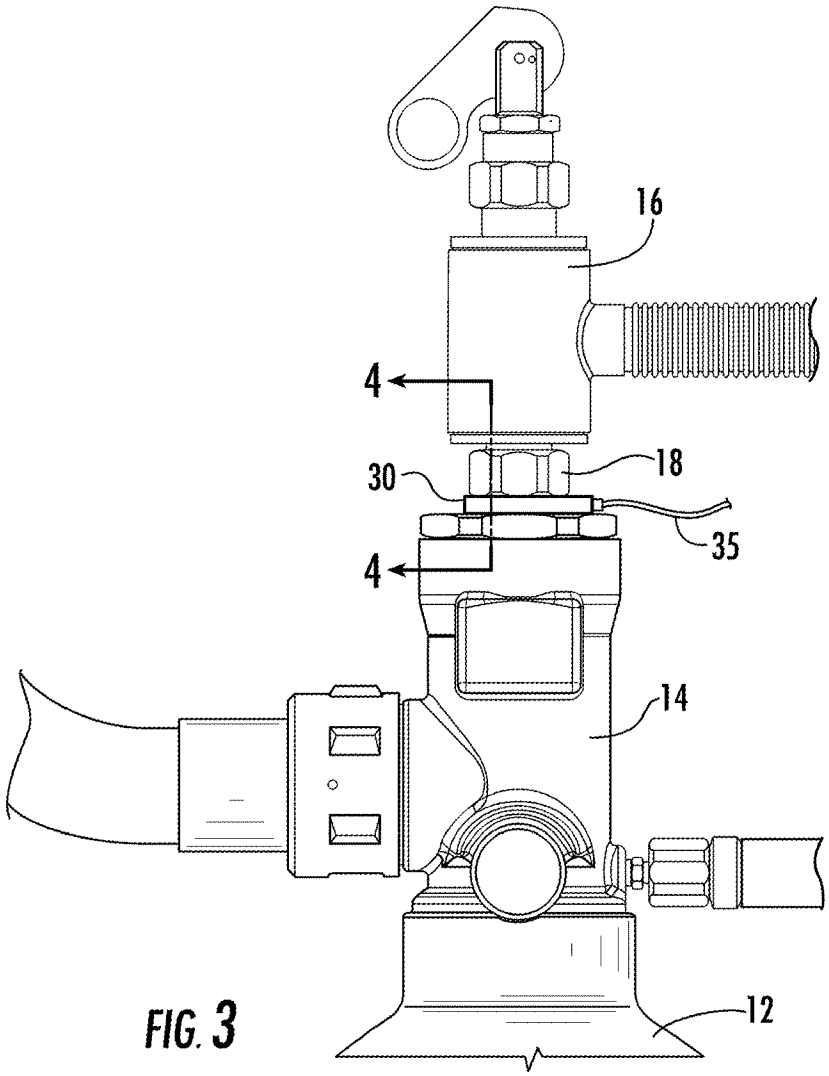
FIG. 3 is a localized side elevational view of the supervised fire suppression system of the subject invention, with the supervisory switching device installed on the connection between the control head and the discharge valve on the storage container.
Figure 4:
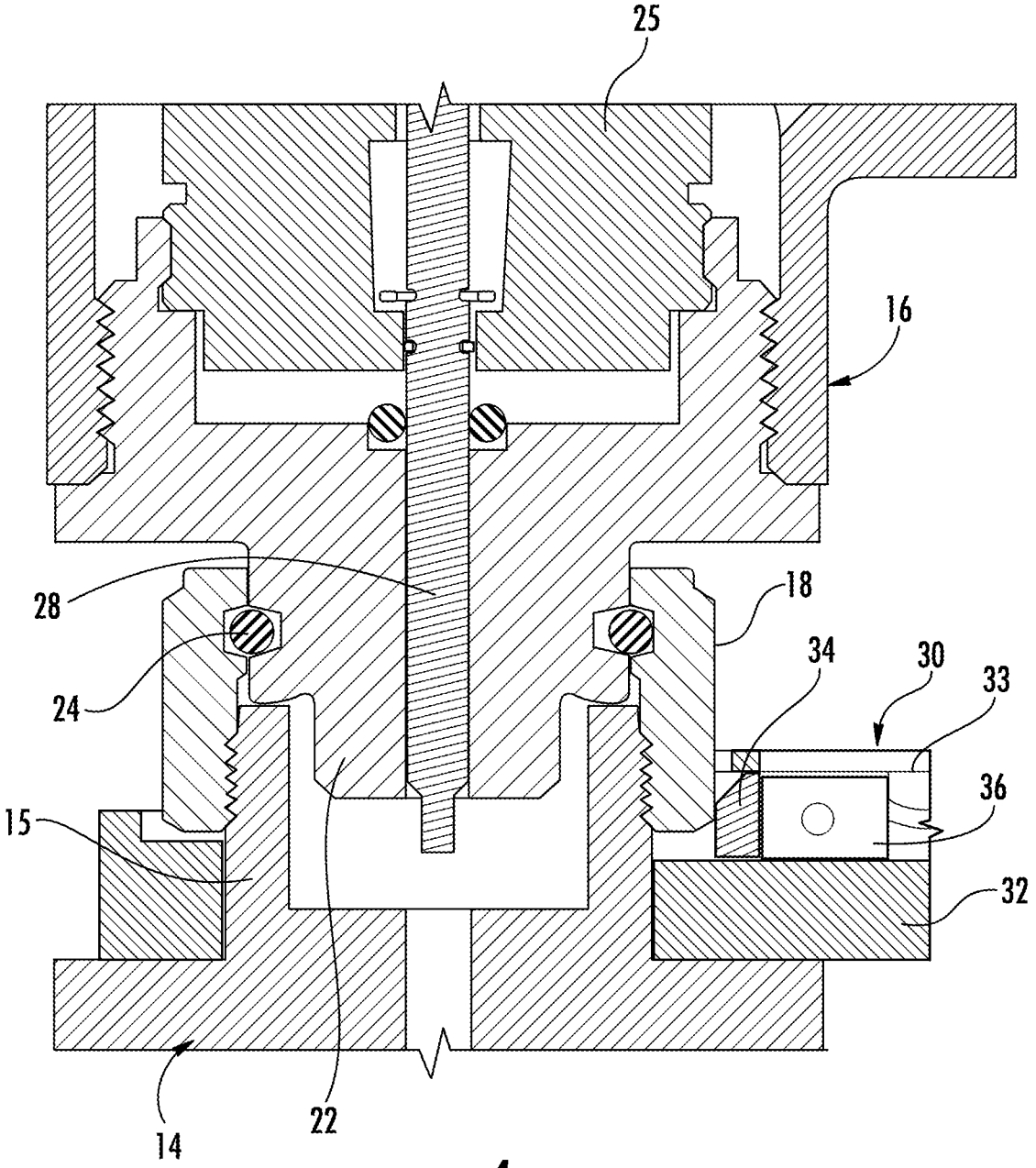
FIG. 4 is a cross-sectional view taken along line 4-4 of FIG. 3, illustrating internal components of the control head, including the solenoid actuator, which activates the discharge valve.

Referring now to FIGS. 3 and 4, there is illustrated an embodiment of the subject invention in which an externally mounted supervisory switching device 30 is mounted between the control head 16 and the discharge valve assembly 14 for monitoring the integrity of the fire suppression system 10. More particularly, the supervisory switching device 30 is mounted on the neck 15 of discharge valve assembly 14 to monitor the position of the control head 16 relative to the discharge valve assembly 14 by referencing the outer periphery of swivel nut 18. The switching device 30 communicates with a control panel (not shown) by way of communication cable 35.

Importantly, the control head 16 houses an electronic actuator or solenoid valve 25. The solenoid valve 25 includes a central shaft pin 28 configured to actuate the valve assembly 14 in the event of a fire, as shown in FIG. 4. The solenoid valve 25 is a critical component of the system 10 that is typically inspected when the control head 16 is removed from the discharge valve assembly 14 for maintenance, which necessitates electronic supervision to ensure proper reinstallation of the control head 16.

The externally mounted supervisory switching device 30 is adapted and configured to physically interact with the threaded swivel nut 18 that joins the discharge valve 14 and control head 16 together. The threaded swivel nut 18 is rotatably associated with the central column 22 of the control head 16 through an annular lock ring 24. It is also threadably associated with the neck 15 of the discharge valve 14. Moreover, when the control head 16 is removed from the discharge valve assembly 14, the swivel nut 18 will remain with the control head 16, not with the valve assembly 14. The physical interaction of the switching device 30 and swivel nut 18 will be discussed in greater detail below.

Figure 5:
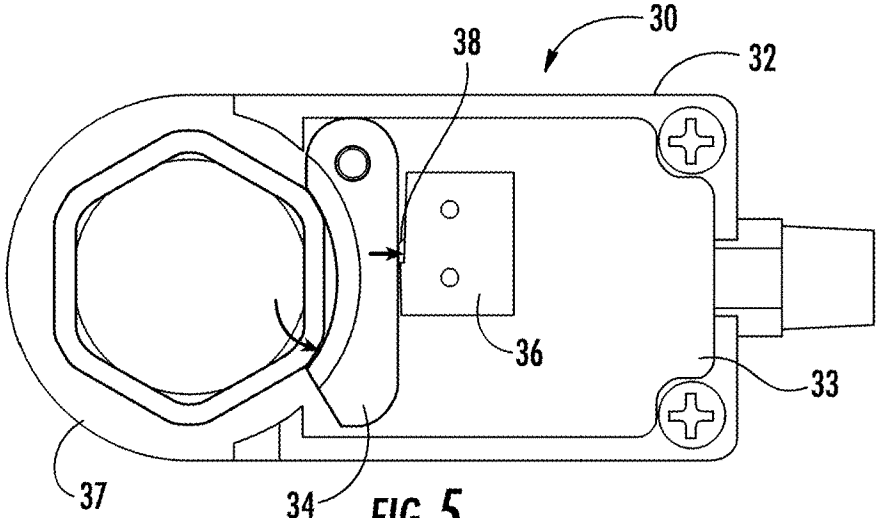
FIG. 5 is a top plan view of an externally mounted supervisory switching device constructed in accordance with an embodiment of the subject invention, wherein the switching mechanism is in a state corresponding to the control head being installed on the discharge valve, and wherein the trigger is in contact with the swivel nut that secures the control head to the discharge valve.
Figure 6:
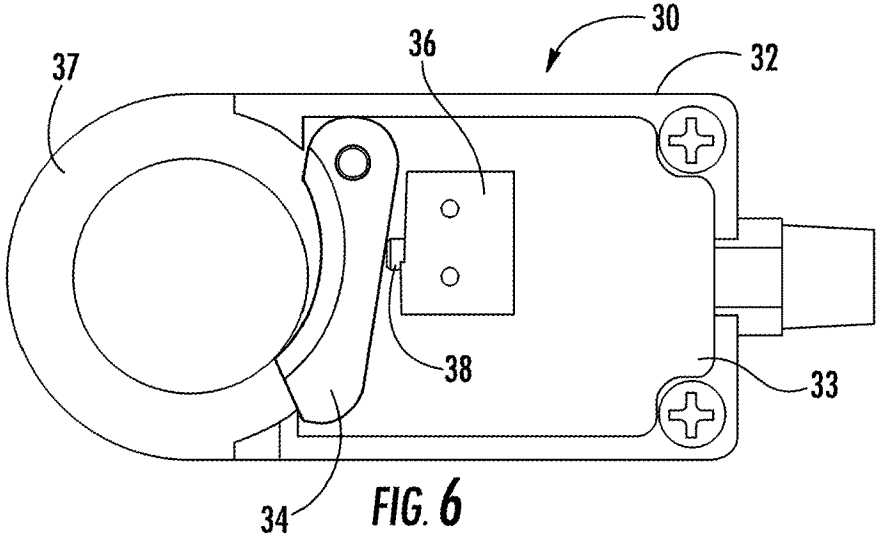
FIG. 6 is a top plan view of the externally mounted supervisory switching device shown in FIG. 5, wherein the switching mechanism is in an first state corresponding to the control head being removed or otherwise disengaged from the discharge valve.

Referring to FIGS. 5 and 6, the externally mounted supervisory switching device 30 includes a generally rectangular housing 32 having a cover 33 and an integral engagement collar 37. The collar 37 is dimensioned and configured to encircle the neck 15 of the discharge valve 14 without interfering with the geometry of the swivel nut 18. This allows the control head 16 to be fully seated on the neck 15 of the discharge valve 14, as shown in FIG. 4. Moreover, the switching device 30 can be readily retrofit onto existing fire suppression systems 10 without the need for any physical or structural modifications to the control head or valve assembly.

A pivoting trigger 34 and a micro switch 36 are arranged within the housing 32 of switching device 30. The micro switch 36 includes a spring biased contact pin 38 that cooperates with the trigger 34. The trigger 34 is adapted and configured to physically interact with an exterior radial face of the swivel nut 18. Consequently, the trigger 34 is not sensitive to or otherwise dependent upon the height to which the swivel nut 18 is tightened upon installation. Furthermore, the pivoting trigger 34 is adapted and configured to move between a first position contacting the outer periphery of swivel nut 18, as shown in FIG. 5, and a second position out of contact with the swivel nut 18, shown in FIG. 6.

The first position shown in FIG. 5 corresponds to the control head 16 being connected to the discharge valve assembly 14, wherein the micro switch 36 is in a first state. At such a time, an indication that the system 10 is ready for use would be provided at the control panel 20. The second position shown in FIG. 6 corresponds to the control head 16 being removed from the valve assembly 14, wherein the micro switch 36 is in a second state. In the second state the micro switch 36 will provide an indication that the control head 16 has been removed from the discharge valve assembly 14 for inspection and/or maintenance. At such a time, an audible and/or visible indication that the system 10 is impaired would be provided at the control panel 20.

Figure 7:
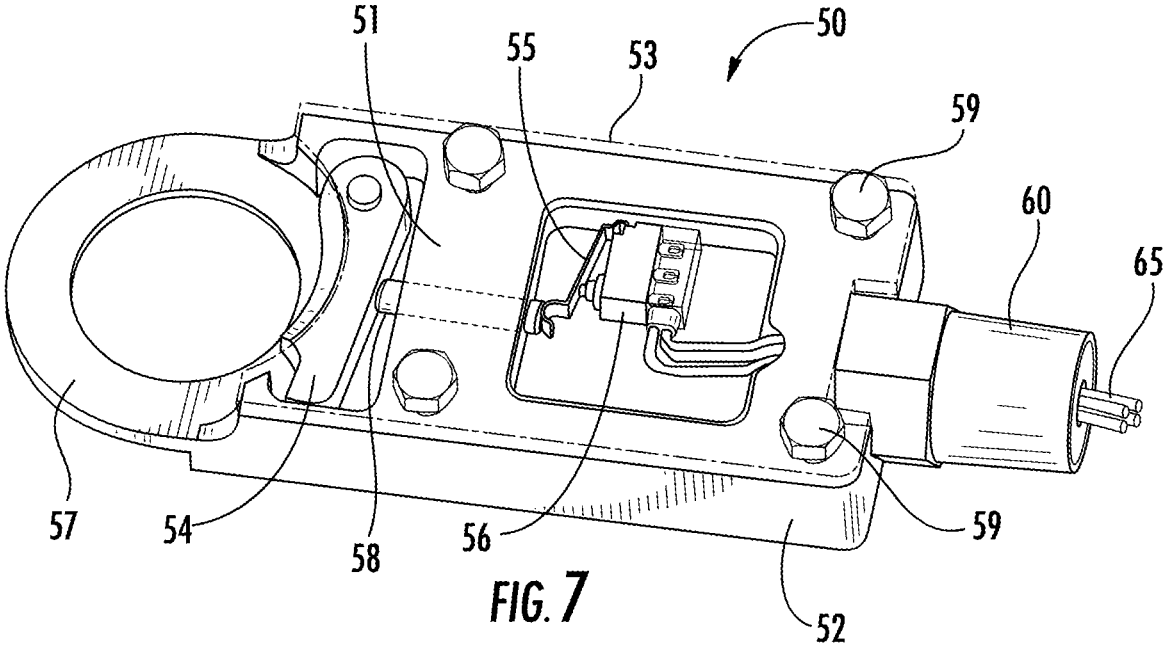
FIG. 7 is a perspective view of another externally mounted supervisory switching device constructed in accordance with the subject invention, wherein the switching mechanism is in a second state corresponding to the control head being installed on the discharge valve, with the trigger biased into contact with the swivel nut that secures the control head to the discharge valve.
Figure 8:
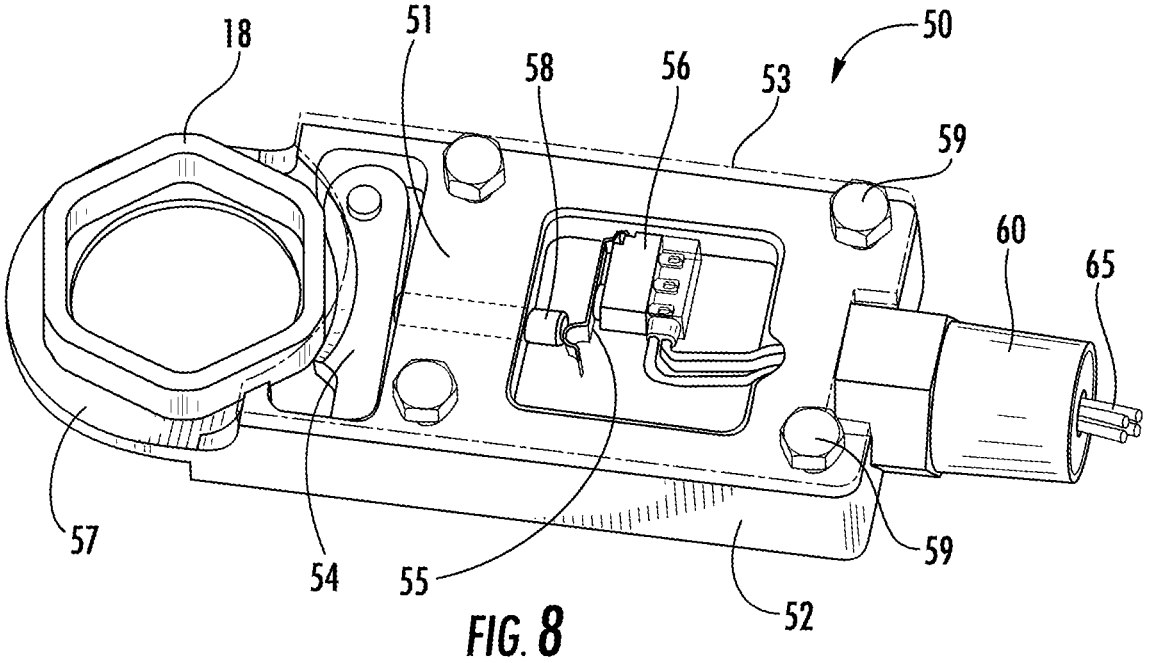
FIG. 8 is a perspective view of the supervisory switching device shown in FIG. 7, wherein the switching mechanism is in a state corresponding to the control head being removed or otherwise disengaged from the discharge valve.

Referring now to FIGS. 7 and 8, there is illustrated another embodiment of the externally mounted supervisory switching device of the subject invention, which is designated generally by reference numeral 50. Switching device 50 operates in substantially the same way as switching device 30; however the construction of device 50 is somewhat different.

In particular, in switching device 50 the micro switch 56 includes a spring biased arm 55 that interacts with a sliding contact pin 58 supported within a central bearing wall 51 of the housing 52. The housing 52 includes a cover 53 secured by plural fasteners 59 and a collar 57 for engaging the neck 15 of valve assembly 14. The housing 52 also includes a fitting 60 for accommodating the passage of communication cables 65.

The contact pin 58 is adapted and configured to cooperate with the pivoting trigger 54 that physically interacts with the periphery of swivel nut 18 that is rotatably supported on the central column 22 of the control head 16, as illustrated for example in FIG. 4. As previously described, when the swivel nut 18 is displaced from the discharge valve assembly 14 along with control head 16, the trigger 54 will pivot as it is urged by contact pin 58 under the bias of the spring arm 55 of micro switch 56. This will cause the micro switch 56 to change state, providing an indication that the control head 16 has been removed from the discharge valve assembly 14.

Figure 9:
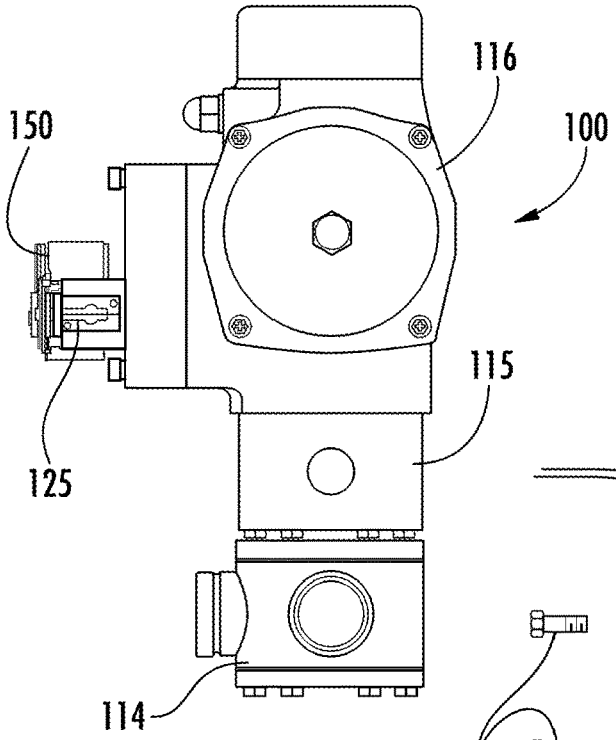
FIG. 9 is a side elevational view of a supervised pneumatic selector ball valve actuator assembly for a fire suppression system which includes a supervisory bracket that must be removed to access an electronic actuator associated with the pneumatic actuator.
Figure 10:
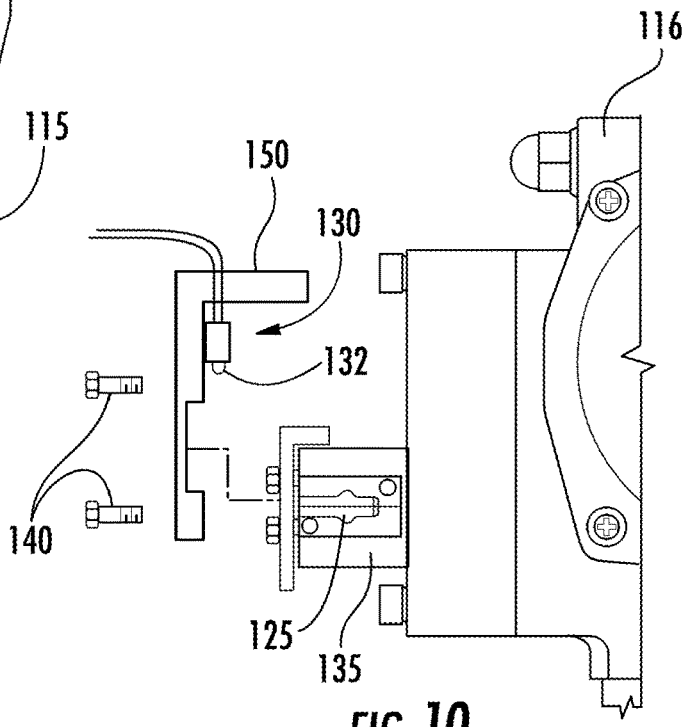
FIG. 10 is an enlarged localized view of the pneumatic actuator shown in FIG. 9, with the supervisory bracket removed, wherein the supervisory bracket includes a mechanical switching mechanism configured for physical contact with the housing of the electronic actuator.
Figure 11:
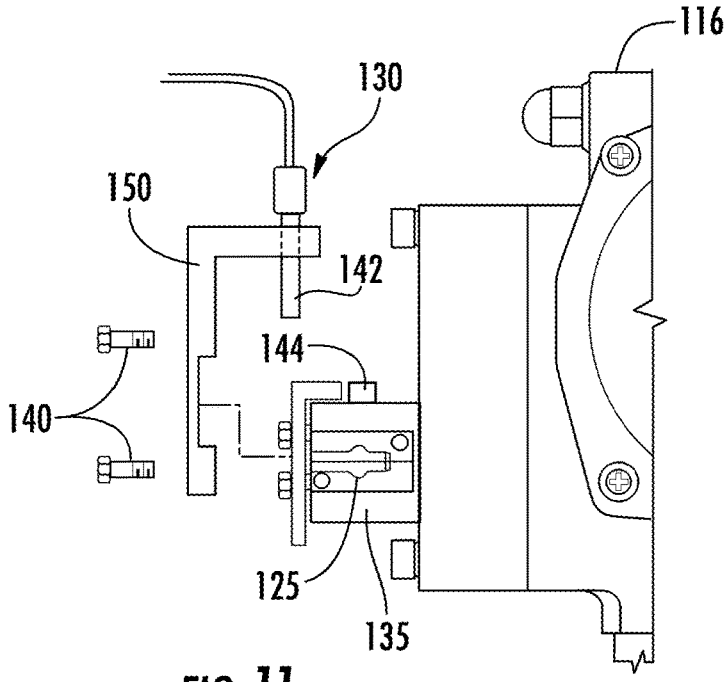
FIG. 11 is an enlarged localized view of the pneumatic actuator shown in FIG. 9, with the supervisory bracket removed, wherein the supervisory bracket includes a proximity switching mechanism operated by magnetic interaction with a target on the housing of the electronic actuator.

Referring now to FIGS. 9 through 11, there is illustrated another fire suppression system constructed in accordance with an embodiment of the subject invention, which is designated generally by reference numeral 100. Fire suppression system 100 includes a ball valve assembly 114 for controlling the release of a fire extinguishing agent from a storage container (not shown). A pneumatic actuator 116 is operatively connected to the ball valve assembly 114 by way of a mounting bracket 115. The pneumatic actuator 116 is adapted and configured for actuating the ball valve 114 in the event of a fire.

The pneumatic actuator 116 includes a solenoid valve 125 that may be removed from the system 100 for inspection and/or maintenance. The system 100 includes an external switching device 130 configured to interact with the pneumatic actuator 116 to provide an indication relating to removal of the solenoid valve 125 from the pneumatic actuator 116 for scheduled inspection and/or maintenance.

The external switching device 130 communicates with a control panel (not shown) located remote from the pneumatic actuator 116 where an indication relating to removal of the solenoid valve 125 from the pneumatic actuator 116 is provided, as shown for example in FIG. 2. The external switching device 130 is mounted on a supervision bracket 150 that is removably connected to a housing 135 of the solenoid valve 125 by threaded fasteners 140. Removal of the supervision bracket 150 is required to gain access to the solenoid valve 125 for scheduled maintenance.

In one embodiment of the subject invention, the external switching device 130 includes a micro switch 132 operated by physical contact with the housing 135 of the solenoid valve 125, as shown in FIG. 10. In another embodiment of the subject invention, the external switching device 130 includes a proximity switch 142 operated by being in physical proximity to a magnetic target 144 located on the housing 135 of the solenoid valve 125, as shown in FIG. 11.

Those skilled in the art will readily appreciate that the externally mounted supervisory switching devices of the subject invention facilitates compliance with regulatory standards that require actuator supervision, benefitting the manufacturers and suppliers of fire suppression systems. The subject invention also benefits the end user of the system by providing an additional safeguard against improper maintenance. Furthermore, the subject invention provides benefits to the system installation/maintenance provider, reducing the chance of damages resulting from inactivity of a disabled system.

While the externally mounted supervisory switching devices subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A supervised fire suppression system comprising:

a) a valve assembly for controlling release of a fire extinguishing agent from a container;

b) an actuator operatively associated with the valve assembly for actuating the valve assembly in the event of a fire, wherein the actuator may be disengaged from the fire suppression system;

c) an externally mounted supervisory switching device configured to interact with the actuator to provide an indication relating to disengagement of the actuator, wherein the actuator is a solenoid valve disposed within a control head, and the control head is detachably connected to a discharge valve assembly, wherein the external switching device is mounted between the control head and the valve assembly, wherein the external switching device includes a housing containing a pivoting trigger and a micro switch in spring biased contact with the trigger, wherein the trigger is adapted and configured to physically interact with a swivel nut that detachably connects the control head to the valve assembly, and wherein the pivoting trigger is adapted and configured to move between a first position in contact with the swivel nut corresponding to the control head being connected to the valve assembly so that the micro switch is in a first state, and a second position out of contact with the swivel nut corresponding to the control head being removed from the valve assembly so that the micro switch is in a second state to provide an indication that the actuator has been removed for inspection, wherein the pivoting trigger is on a pivot with a pivot axis that is parallel to a swivel axis of the swivel nut.

2. A supervised fire suppression system as recited in claim 1, wherein the external switching device communicates with a control panel located remote from the actuator and provides an indication relating to disengagement of the actuator to the control panel.

3. A supervised fire suppression system comprising:

a) a valve assembly for controlling release of a fire extinguishing agent from a container;

b) an actuator operatively associated with the valve assembly for actuating the valve assembly in the event of a fire, wherein the actuator may be disengaged from the fire suppression system; and c) an externally mounted supervisory switching device configured to interact with the actuator to provide an indication relating to disengagement of the actuator, wherein the actuator is a solenoid valve detachably mounted to a pneumatic actuator, and the pneumatic actuator is mounted to a ball valve assembly through a mounting bracket, wherein the external switching device is mounted on a supervision bracket that is removably connected to a housing of the solenoid valve, and wherein removal of the supervision bracket is required to gain access to the solenoid valve, wherein the external switching device includes a micro switch operated by physical contact with the housing of the solenoid valve, wherein the external switching device includes a proximity switch operated by physical proximity to a magnetic target located on the housing of the solenoid valve.

4. A supervised fire suppression system comprising:

a) a discharge valve for controlling the release of a fire extinguishing agent from a container;

b) a control head housing an electronic actuator that is operatively associated with the discharge valve for actuating the discharge valve in the event of a fire, wherein the control head may be removed from the discharge valve to facilitate inspection of the electronic actuator housed within the control head; and c) an externally mounted supervisory switching device supported on the discharge valve and configured to interact with the control head to provide an indication that the control head has been removed from the discharge valve, wherein the electronic actuator is a solenoid valve housed within the control head, and the control head is detachably connected to the discharge valve by a swivel nut operatively associated with the control head, wherein the external switching device includes a housing containing a pivoting trigger and a micro switch in spring biased contact with the trigger, wherein the trigger is adapted and configured to physically interact with the swivel nut associated with the control head, wherein the pivoting trigger is adapted and configured to move between a first position in contact with the swivel nut corresponding to the control head being connected to the discharge valve so that the micro switch is in a first state, and a second position out of contact with the swivel nut corresponding to the control head being removed from the discharge valve so that the micro switch is in a second state to provide an indication that the control head has been removed from the discharge valve, wherein the pivoting trigger is on a pivot with a pivot axis that is parallel to a swivel axis of the swivel nut.

5. A supervised fire suppression system as recited in claim 4, wherein the external switching device communicates with a control panel located remote from the control head and provides an indication relating to removal of the control head from the discharge valve to the control panel.

6. A supervised fire suppression system comprising:

a) a ball valve for controlling the release of a fire extinguishing agent from a storage container;

b) a pneumatic actuator operatively connected to the ball valve for actuating the ball valve in the event of a fire, wherein the pneumatic actuator incudes a solenoid valve that may be removed from the system for inspection; and c) an external switching device configured to interact with the pneumatic actuator to provide an indication relating to removal of the solenoid valve from the pneumatic actuator, wherein the external switching device communicates with a control panel located remote from the pneumatic actuator where and provides an indication relating to removal of the solenoid valve from the pneumatic actuator to the control panel, wherein the external switching device is mounted on a supervision bracket that is removably connected to a housing of the solenoid valve, and wherein removal of the supervision bracket is required to gain access to the solenoid valve wherein the external switching device includes a micro switch operated by physical contact with the housing of the solenoid valve, wherein the external switching device includes a proximity switch operated by physical proximity to a magnetic target located on the housing of the solenoid valve.

* * * * *